US006702386B2

(12) United States Patent
Davis et al.

(10) Patent No.: US 6,702,386 B2
(45) Date of Patent: Mar. 9, 2004

(54) HEIGHT AND PIVOT-ADJUSTABLE CHAIR ARM

(75) Inventors: Keith L. Davis, Wilton, IA (US); Matthew J. Phillips, Muscatine, IA (US); Rodney C. Schoenfelder, Spakopee, MN (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 09/881,818

(22) Filed: Jun. 15, 2001

(65) Prior Publication Data

US 2003/0042782 A1 Mar. 6, 2003

(51) Int. Cl.[7] ..... A47C 7/54
(52) U.S. Cl. ..... 297/411.35; 297/411.36
(58) Field of Search ..... 297/115, 116, 297/344.26, 411.35, 411.36, 411.37, 411.38, 411.31, 344.19; 248/118, 118.3, 162.1, 631, 289.11

(56) References Cited

U.S. PATENT DOCUMENTS

| | | | | | |
|---|---|---|---|---|---|
| 4,720,068 | A | * | 1/1988 | Tornero | 248/161 |
| 5,393,124 | A | | 2/1995 | Neil | |
| 5,407,249 | A | | 4/1995 | Bonutti | |
| 5,497,966 | A | * | 3/1996 | Fuhrmann | 248/161 |
| 5,590,934 | A | | 1/1997 | Gibbs | |
| 5,641,203 | A | | 6/1997 | Van De Riet et al. | |
| 5,647,638 | A | | 7/1997 | Ritt et al. | |
| 5,655,814 | A | | 8/1997 | Gibbs | |
| 5,738,318 | A | * | 4/1998 | Thole et al. | 248/188.5 |
| 5,749,628 | A | | 5/1998 | Synder et al. | |
| 5,765,804 | A | | 6/1998 | Stumpf et al. | |
| 5,853,223 | A | | 12/1998 | Ritt et al. | |
| 5,884,976 | A | | 3/1999 | Breen et al. | |
| 5,895,095 | A | | 4/1999 | Chen | |
| 5,908,221 | A | | 6/1999 | Neil | |
| 5,931,536 | A | | 8/1999 | Wu | |
| 5,944,386 | A | | 8/1999 | Yamagishi et al. | |
| 5,971,484 | A | | 10/1999 | Lamart et al. | |
| 6,045,191 | A | * | 4/2000 | Piretti | 297/411.37 |
| 6,053,578 | A | | 4/2000 | van Hekken et al. | |
| 6,076,891 | A | * | 6/2000 | Bernhardt | 297/411.31 |
| 6,076,892 | A | | 6/2000 | van Hekken et al. | |
| 6,079,786 | A | * | 6/2000 | Kirkland et al. | 297/344.24 |
| 6,106,070 | A | | 8/2000 | Ritt et al. | |
| 6,345,864 | B1 | * | 2/2002 | Rivera et al. | 297/130 |

* cited by examiner

*Primary Examiner*—Peter M. Cuomo
*Assistant Examiner*—Stephen Vu
(74) *Attorney, Agent, or Firm*—Joseph H. Golant; Jones Day

(57) ABSTRACT

A height and pivot-adjustable office chair arm assembly with an arm rest that can be raised to different vertical positions by actuation of a gas cylinder and having a shroud surrounding and vertically movable with respect to at least a portion of an arm support that is hollow and surrounds the gas cylinder such that the shroud is vertically movable in relation to at least a portion of the arm support. The shroud is connected to the gas cylinder at an upper end for vertical movement by the gas cylinder. An arm rest pivot support is attached only to the shroud and receives the arm rest assembly and enables the arm rest assembly to pivot in a horizontal plane thereby allowing the arm rest assembly to assume any selected rotational position.

16 Claims, 5 Drawing Sheets

HEIGHT AND PIVOT-ADJUSTABLE CHAIR ARM

BACKGROUND OF THE INVENTION

1. Field of the Invention

The present invention relates in general to an office chair arm rest and in particular to an office chair arm rest that can be adjusted in height and rotation about a vertical axis.

2. Description of Related Art Including Information Disclosed Under 37 C.F.R. §§1.97 and 1.98

There are many different patents disclosing chair arm rests that can be adjusted vertically in height and rotationally in a horizontal plane to conform to the arms of the user of the chair.

Some of these patents disclose hydraulic actuators for raising and lowering the arm rest, such as U.S. Pat. Nos. 5,931,536; 5,908,221; and 5,765,804.

Others disclose some manually-activated support shafts that can be manually raised and lowered with some type of engaging device. Some of such patents are U.S. Pat. Nos. 5,393,124; 5,971,484; 6,053,578; 5,895,095; 5,749,628; 5,641,203; 5,647,638; and 5,407,249.

Other patents disclose strictly horizontally-adjustable arm rests such as disclosed in U.S. Pat. Nos. 5,590,934; 5,655,814; 5,884,976; 5,944,486; and 6,045,191.

All of these patents disclose complex mechanisms for raising and lowering the arm rest and for pivoting the arm rest in a horizontal plane.

It would be in a desirable to have an arm rest that can be moved both in the vertical plane and rotated horizontally with simple mechanisms that are easily constructed and easily usable.

SUMMARY OF THE INVENTION

The present invention relates to a height and pivot-adjustable office chair arm assembly that is operated vertically to provide different arm rest heights using a gas cylinder and is rotated in a horizontal plane about a vertical axis using a simple radially-biased ball bearing and detent assembly that is operable independent of the mechanism for raising and lowering the chair arm rest.

The chair arm assembly has an arm rest assembly thereon and comprises an arm support having one end for attaching the chair arm assembly to a chair and having an opposite end. A gas cylinder cooperates with the arm support for movement in the vertical direction to raise and lower the arm rest assembly to any selected vertical position. A shroud surrounds and vertically moves in relation to at least a portion of the arm support and has an upper end. The shroud is connected to the gas cylinder for vertical movement by the gas cylinder and an arm rest pivot support attached only to the shroud receives the arm rest assembly and enables the arm rest assembly to pivot in a horizontal plane thereby allowing the arm rest to assume a selected rotational position independent of the operation of the gas cylinder mechanism.

The shroud is formed of a hollow tube that slidedly receives the arm support. It has a cross-sectional shape that conforms to the cross-sectional shape of the arm support and is such that the shroud can move vertically with respect to arm support but is non-rotatable with respect to the arm support. In the preferred embodiment, the cross-sectional shape of the shroud and the arm support are ovate.

The arm rest assembly itself has an upper arm pad assembly for receiving the arm of the user, and a lower arm pad assembly that has a first end attached to the upper arm pad assembly, and a second end having a bearing and ring assembly that is associated with the arm rest pivot support that is attached only to the shroud. There is a detent carrying device fixedly attached to the lower end of the shroud to mate with the bearing support ring and assist in holding the arm rest in a given horizontal rotational position. The detent carrying device matingly engages the at least one bearing and spring assembly to enable the bearing to rotatively move from one detent to another as the arm rest pivot support plate is rotated about a substantially vertical axis to establish a given rotational position of the arm rest.

The novel detent-carrying device has a plurality of vertically-oriented detents and there are at least one bearing and spring assembly on the lower arm pad assembly such that each of the bearings radially engages a different one of the detents for releasably holding the arm rest in a given rotational position. In the preferred embodiment, the bearings are ball bearings biased radially against elongated vertically-positioned detents by springs or other resilient devices. The bearings could also be roller bearings that would also be biased radially against the detents by the springs. In the preferred embodiment, at least two sets of three detents are disposed on diametrically-opposed sides of the shroud, and each of the at least two bearings radially and releasably engages a corresponding set of detents. The top of the shroud is circular with an outer periphery for carrying the vertically-oriented detents. The bearing and spring assemblies are spaced from each other with each of the bearings releasably and radially engaging corresponding detents and enabling the arm rest assembly to assume any selected horizontal position represented by the detents. In the preferred embodiments, the detents allow 40° rotation of the arm rest assembly.

Further, the novel arm rest assembly comprises a substantially V-shaped arm pad assembly having first and second legs joined at one end. The first leg forms a substantially-horizontal upper rest for the user's arm, and the second leg is a lower rest for attachment for the shroud upper end, and the first leg is longer than the second leg.

In the preferred embodiment, the second leg is at least partially hollow with a lever actuator extending from the hollow portion of the second leg engaging and operating a lever extending through the partially-hollow second leg between the lever actuator and the gas cylinder such that the lever actuator can be used to move the lever to actuate the gas cylinder and enable raising and lowering of the arm rest assembly.

Thus, it is an object of the present invention to provide an arm rest for a chair that can be adjusted both vertically and rotationally in the horizontal plane about the vertical axis for adapting to a particular user.

It is also an object of the present invention to provide an arm rest assembly that is adjustable in the vertical direction with the use of a gas cylinder, and in the horizontal rotational position by a bearing radially biased against the detent assembly.

It is still another object of the present invention to provide a chair arm rest assembly that is movable in a vertical direction with a gas cylinder having an upper end attached to a shroud surrounding an arm support in which the gas cylinder can move vertically with the cross-sectional shape of the shroud and the arm support being such that the shroud can move vertically with respect to the arm support but cannot be rotated.

It is another object of the present invention to provide the shroud and the arm support with a cross-sectional ovate shape to allow sliding vertical relative motion but to prevent horizontal rotation with respect to each other.

It is also an object of the present invention to provide an arm rest assembly that has substantially V-shaped arm pad assembly having first and second legs joined at one end with the first leg forming a substantially-horizontal upper rest for the user's arm and the second leg forming a lower rest for attachment to the shroud upper end with the first leg being longer than the second leg.

Thus, the present invention relates to a height and pivot-adjustable office chair arm assembly having an arm rest assembly thereon and comprising an arm rest support having one end for attaching the chair arm assembly to a chair and having an opposite end; a gas cylinder cooperating with the arm rest support for movement in the vertical direction to raise and lower the arm rest support to any selected vertical position; a shroud surrounding and vertically movable in relation to at least a portion of the arm support and having an upper end; the shroud being connected to the upper end of the gas cylinder for vertical movement; and an arm rest pivot support attached only to the shroud for receiving the arm rest assembly and enabling the arm rest assembly to pivot in a horizontal plane thereby allowing the arm rest assembly to assume any selected rotational position.

BRIEF DESCRIPTION OF THE DRAWINGS

These and other objects of the present invention will be more fully described when taken in conjunction with the following detailed description of the drawings wherein like numerals represent like elements and wherein.

DETAILED DESCRIPTION OF THE PREFERRED EMBODIMENT(S)

Figure 1:
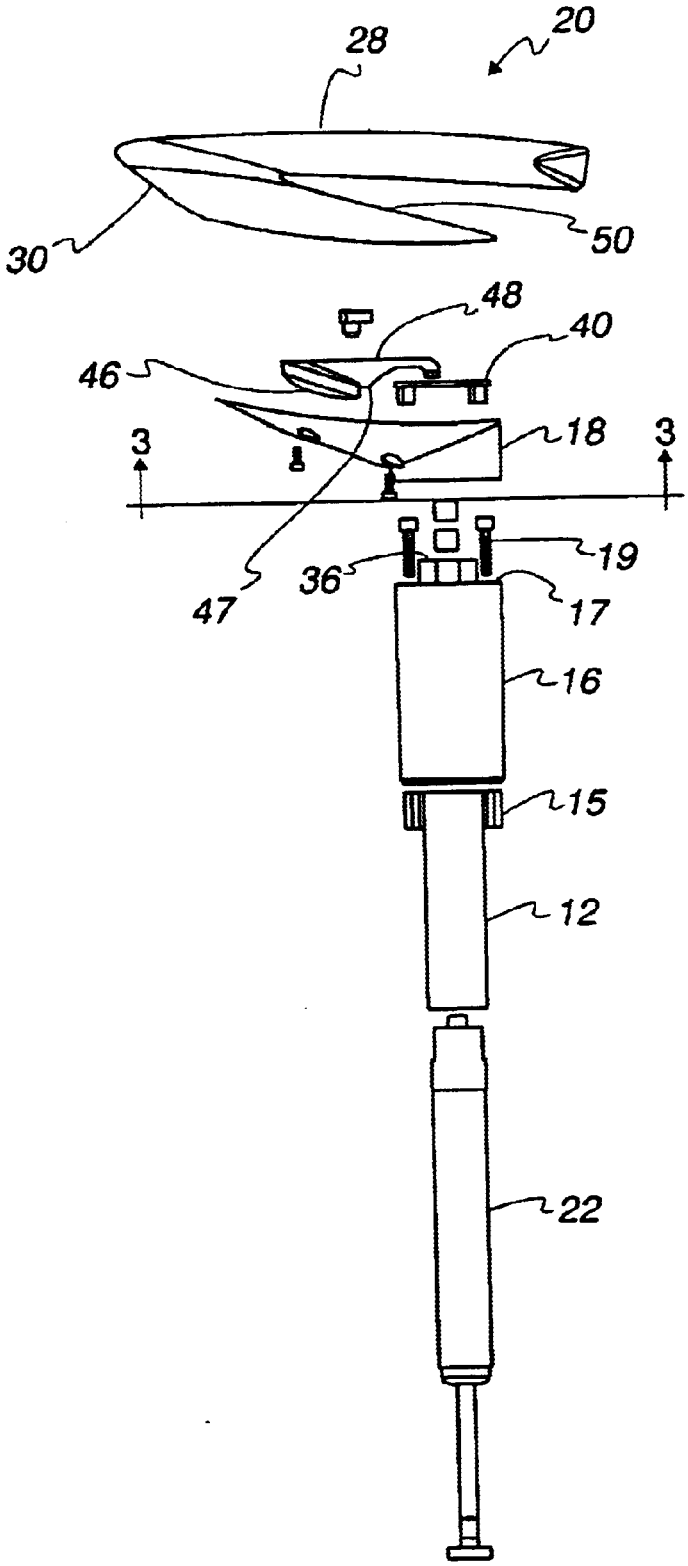
FIG. 1 is a side exploded view of the novel arm rest assembly.

FIG. 1 is an exploded side view of the novel height and pivot-adjusting office chair arm assembly 10. It has an arm support 12 having one end 14 (shown in FIG. 2) for attaching the arm chair assembly 10 to a chair and having an opposite end 15. A gas cylinder 22 is placed within the arm support 12 for movement in the vertical direction to raise and lower arm rest 20 to any selected vertical position. A shroud 16 surrounds and is vertically movable in relation to at least a portion of the arm support 12. The shroud 16 has an upper end 17. The shroud 16 is connected to the gas cylinder 22 with a press-fit for vertical movement by the gas cylinder. An arm rest support plate 18 is attached only to the shroud with the bolts 19 for receiving the arm rest assembly 20 and enabling the arm rest assembly 20 to pivot in a horizontal plane thereby allowing the arm rest assembly 20 to assume any selected rotational position. It can be seen in FIGS. 2 and 4 that the shroud 16 comprises a hollow tube for slidably receiving the arm support 12, and as can best be seen in FIG. 4 has an ovate cross-sectional shape that conforms to the cross-sectional shape of the arm support 12 and is such that the shroud can move vertically with respect to the arm support 12 but is non-rotatable with respect to the arm support 12. Obviously, the cross-sectional shape of shroud 16 and the arm support 12 could be of any shape other than cylindrical so that the shroud can move vertically with respect to the arm support but cannot be rotated. The ovate shape is preferred. The arm rest assembly 20 comprises an upper arm pad assembly 28 for receiving the arm of the user and a lower pad assembly 30 having a first end 32 attached to the upper arm pad assembly 28, and a second end 34 attached to the arm rest pivot support 18. A detent means 36, best shown in FIG. 4, the upper end 17 of the shroud 16 to assist in holding the arm rest assembly 20 in a given horizontal rotational position. The lower arm pad assembly 30 has at least one bearing and spring assembly 40, best shown in FIG. 3, for matingly engaging the detent means 38 on the shroud 16 such that the bearing 40 may rotatively move from one detent means 38 to another as the arm rest pivot support 18 is rotated about a substantially-vertical axis to establish a given rotational position of the arm rest assembly 20.

Figure 3:
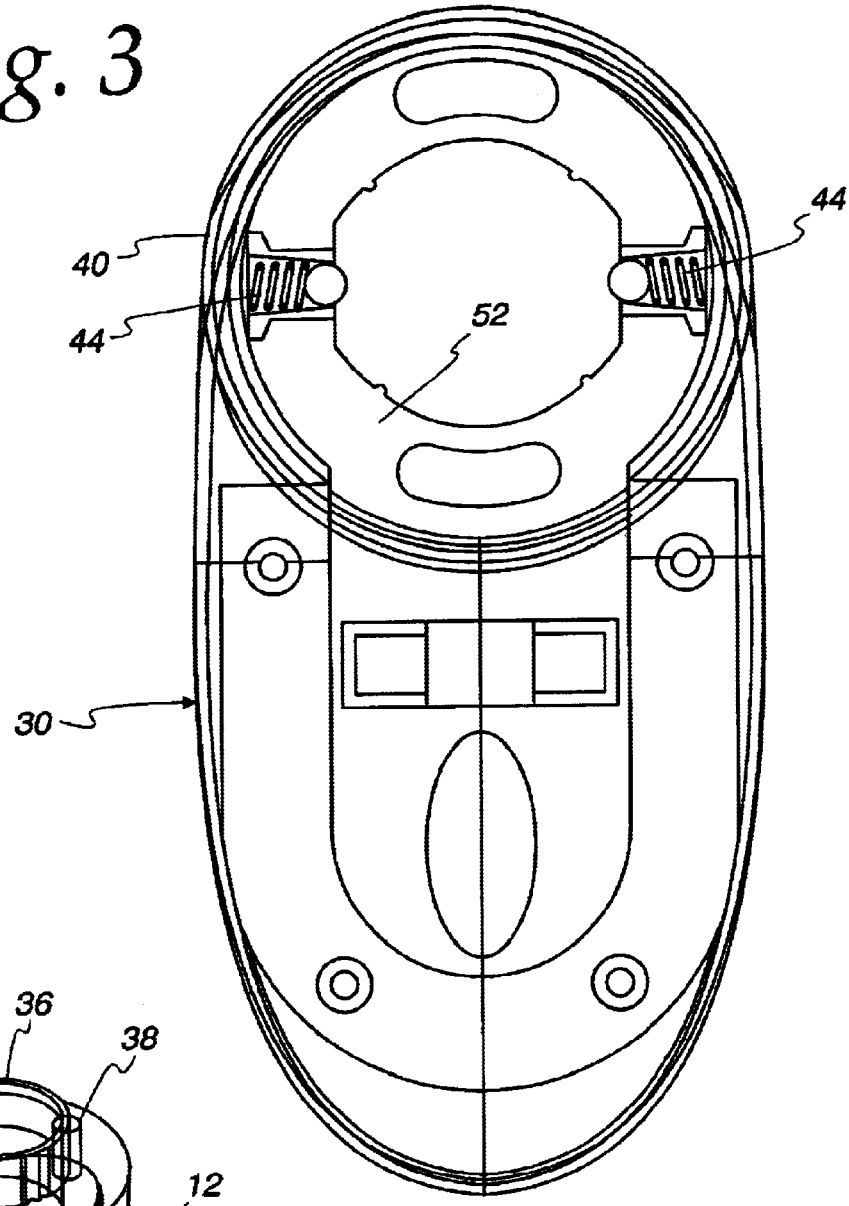
FIG. 3 is a bottom view of the lower arm pad assembly of the arm rest.
Figure 4:
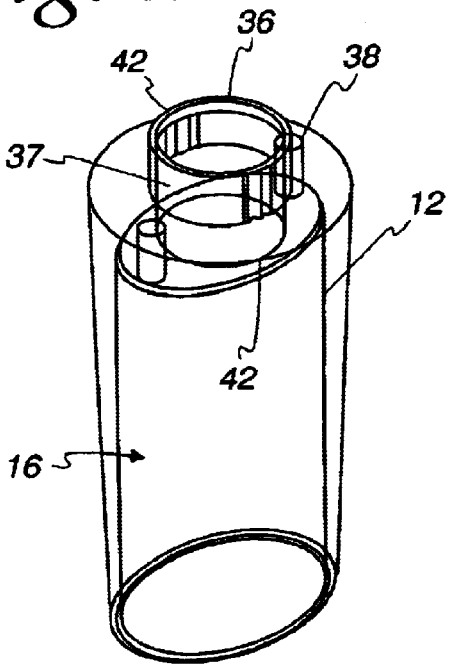
FIG. 4 is a perspective exploded view of the shroud and arm support illustrating the circular detent-carrying device that is attached to the upper end of the shroud.

As can be seen best in FIGS. 3 and 4, a plurality of vertically-oriented detents 42 are located in the shroud 36 and at least one bearing and spring assemblies, 40, 44 on the lower arm pad assembly 30 such that each of the bearings 40 radially engages a different opposing detent 42 for releasably holding the arm rest assembly 20 in the given rotational position. As can be seen in FIGS. 3 and 4, in the preferred embodiment, the bearings are ball bearings biased radially against elongated vertically-positioned detents 42 by springs 44. Of course, roller bearings could be used as the bearings 40. As can be seen in FIG. 4, at least two sets of three detents 42 are disposed on diametrically-opposed sides of the detent-carrying device 36. Each of the at least two bearings 40 radially and releasably engage a corresponding set of detents 42 by means of the springs 44 shown in FIG. 3. It can be seen in FIG. 4 that the detent-carrying device 36 is circular in shape and has an outer periphery 37 for carrying the vertically-positioned detents 42. Also as can be seen in FIG. 3, the bearing and spring assemblies 40, 44 are spaced from each other with each of the bearings 40 releasably and radially engaging corresponding detents 42 and enabling the arm rest assembly 20 to assume any selected horizontal position represented by the detents 42. It can be seen that since the bearings roll against the outer periphery of the shroud 16 in a bearing race 52, that the detent-carrying device 36 allows 40° rotation of the arm rest assembly 20.

Figure 2:
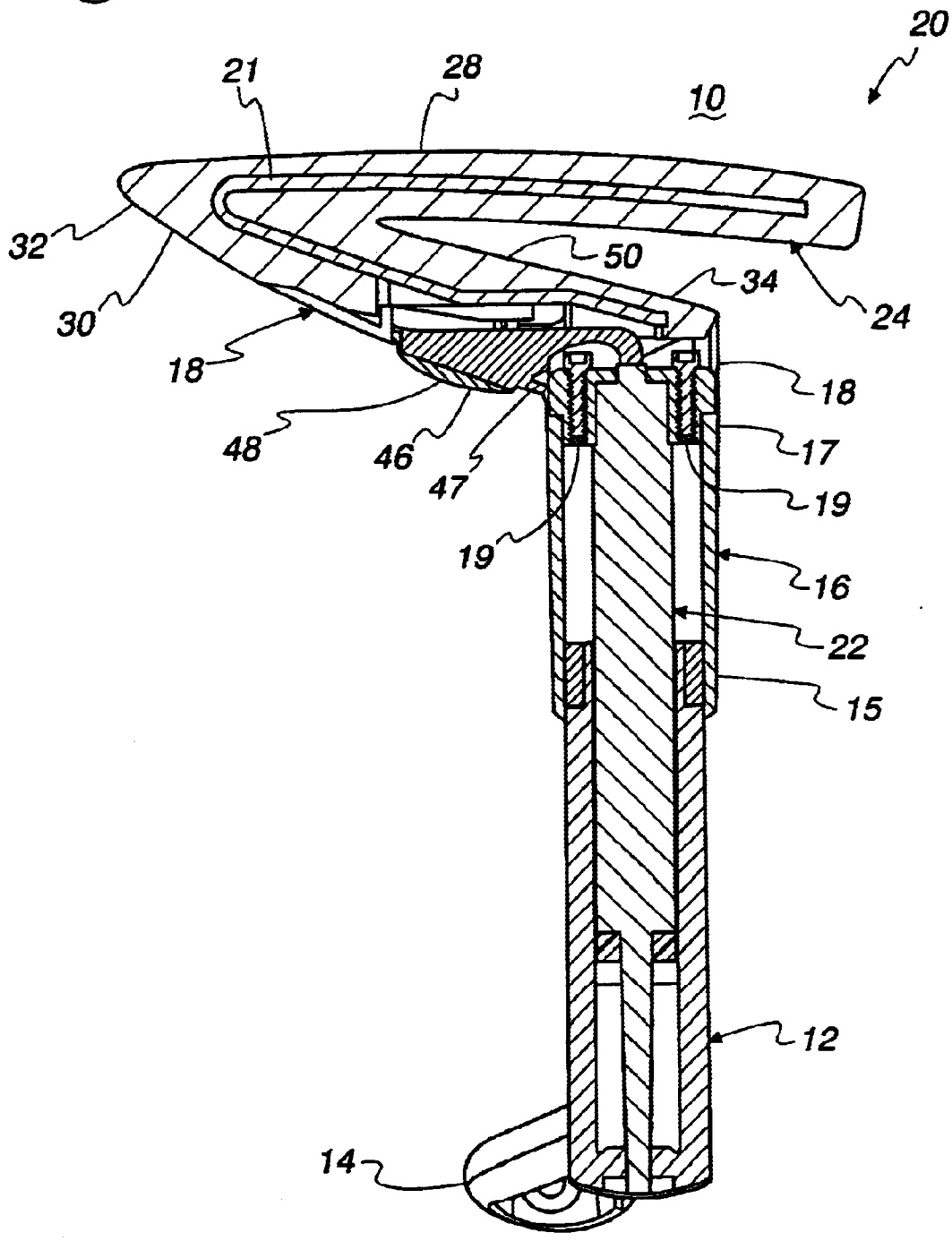
FIG. 2 is a side cross-sectional view of the novel arm rest assembly.

As can best be seen in FIGS. 1 and 2, the arm rest assembly 20 has a substantially V-shaped arm pad assembly having a first leg 28 and second leg 30 joined at the one end 32. The first leg 28 forms a substantially-horizontal upper rest for the user's arm, and the second leg 30 is a lower rest for attachment to the upper end 17 of the shroud 16. It will be noted that the first leg 28 is longer than the second leg 30. It can also best be seen in FIG. 2 that the second leg 30 is at least partially hollow. A lever actuator 46 extends from the hollow portion of the second leg 30 with a lever 48 extending through the partially-hollow second leg 30 between the lever actuator 46 and the gas cylinder 22 such that the lever actuator 46 can be used to move the lever 48 to actuate the gas cylinder 22 and in a well-known manner and enable raising and lowering of the aim rest assembly 20.

It will be noted that FIG. 3 is a bottom view of the lower arm pad assembly 30 taken along line 3—3 in FIG. 1.

Thus, there has been disclosed a novel height and pivot-adjustable arm rest assembly 20 for a chair comprising a hollow main arm support 12 for rigid attachment to the chair at 14; a gas cylinder 22 in the hollow main support arm 12 for raising and lowering the arm rest assembly 20; a hollow housing or shroud 16 surrounding the hollow main arm support 12 for relative, slidable motion in the vertical direction and having an upper portion 17 attached to the upper end of the gas cylinder preferably by a press-fit for movement therewith; a circular detent means 36 mounted on the upper portion 17 of the hollow housing or shroud 16 for establishing arcuate arm rest positions; an arm pad assembly 20 forming a portion of the arm rest assembly 10 for rigid to the upper portion 17 of the hollow shroud 16; and a radially-biased bearing and spring assembly 40 associated with the lower second leg 30 for engaging detents 42 in the circular detent means 36 such that the arm rest assembly 20 may be rotated to any desired arm rest position and releasably held in place by the bearing and spring assembly 40, 44.

Both the hollow main arm support 12 and the hollow housing 16 have corresponding cross-sectional shapes that prevent rotation of the housing 16 with respect to the main arm support 12, but allows relative vertical movement of the housing 16 with respect to the main arm support 12.

In one preferred embodiment, the bearings 40 are roller bearings in a bearing cage 52 with the long bearing axis in the vertical plane for radially engaging the detents to releasably hold the arm rest assembly 20 in the given rotated position. The bearings could be ball bearings in bearing cage 52 for radially engaging the detents 42 to releasably hold the arm rest assembly in the given rotated position.

Figure 5:
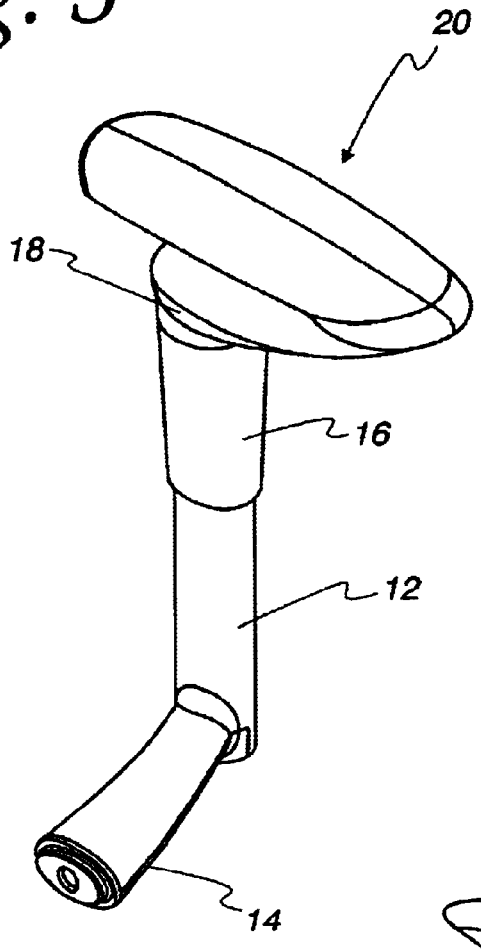
FIG. 5 is a perspective view of the novel arm rest assembly, the arm rest shown in the forward-facing position.

FIG. 5 is a perspective view of the novel office chair arm assembly 10 with the arm rest assembly 20 being centered and pointing in the forward direction.

Figure 6:
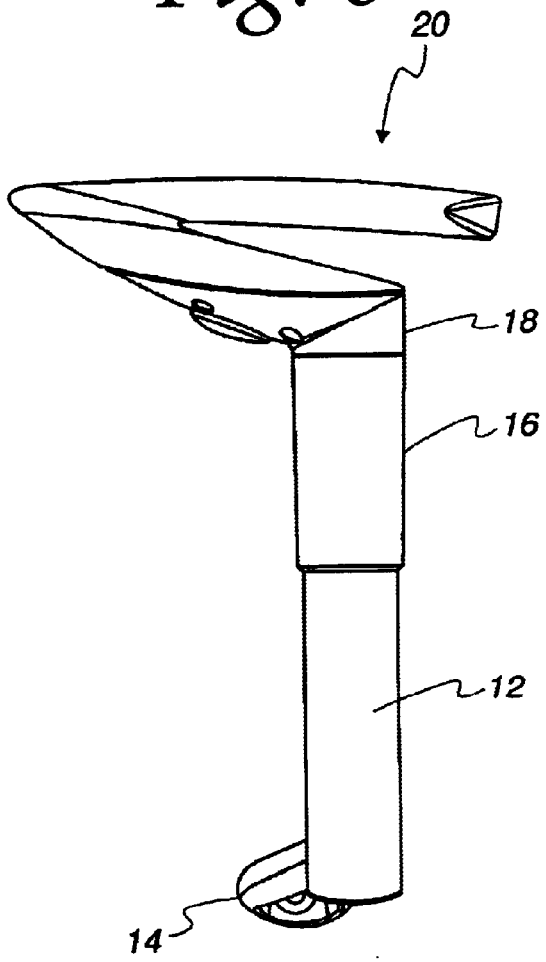
FIG. 6 is a side view of the arm chair assembly shown in FIG. 5.

FIG. 6 is a side view of the office chair arm assembly 10 shown in FIG. 5.

Figure 7:
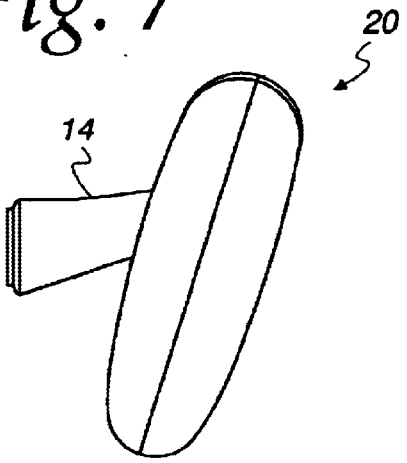
FIG. 7 is a top view of the novel arm rest assembly illustrating rotation of 20° inwardly.
Figure 8:
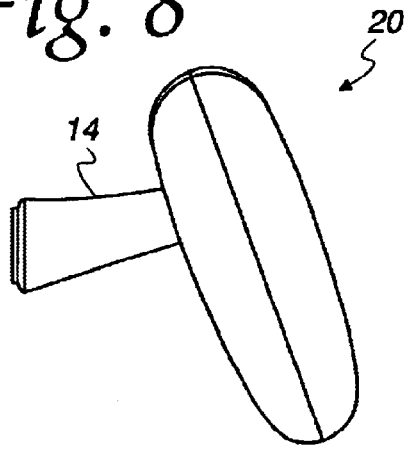
FIG. 8 is a top view of the novel arm rest assembly showing a 20° rotation outwardly.
Figure 9:
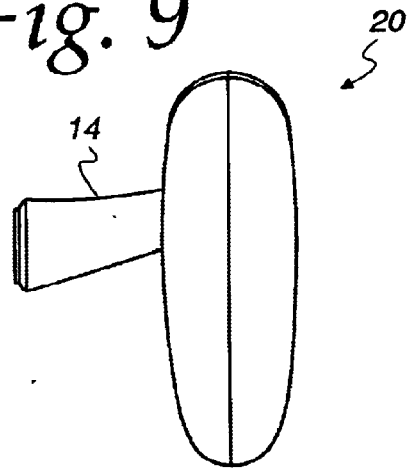
FIG. 9 is a top view of the novel arm rest assembly illustrating the arm rest in the centered forward position.

FIGS. 7, 8 and 9 illustrate, respectively, a top view of the office chair assembly 10 with the arm rest assembly 20 rotated 20° inwardly, 20° outwardly, and centered.

Figure 10:
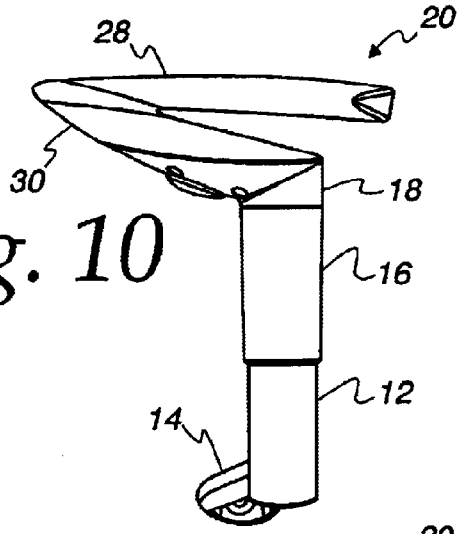
FIG. 10 is a side view of the novel arm rest assembly illustrating the arm rest assembly in its bottom position.
Figure 11:
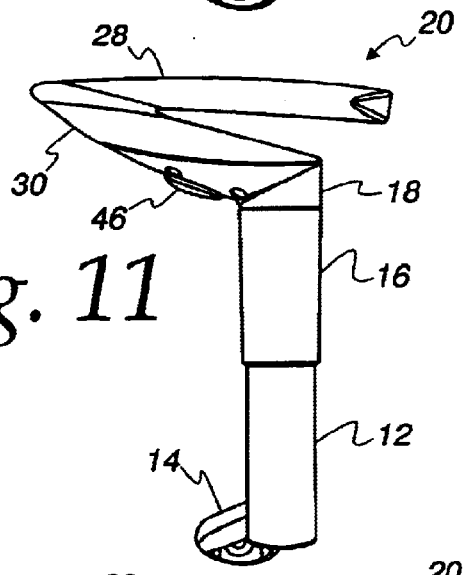
FIG. 11 is a side view of a novel arm rest assembly illustrating the arm rest in its middle vertical position.
Figure 12:
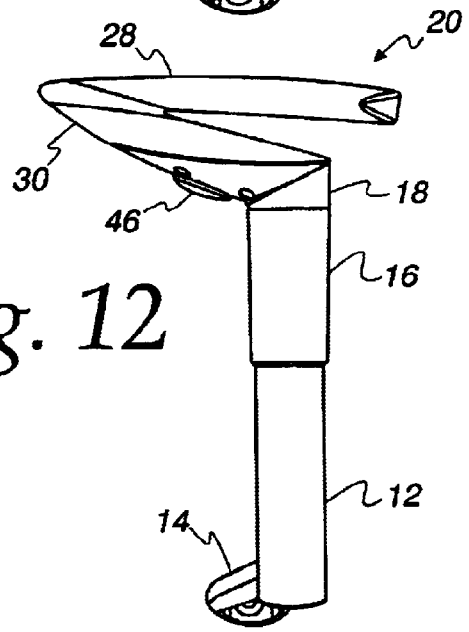
FIG. 12 is a side view of a novel arm rest assembly illustrating the arm rest in its top or most elevated position.

FIGS. 10, 11 and 12 are side views of the novel office chair arm assembly 10 illustrating the arm rest assembly 20 in the lowest, the middle, and the highest arm rest positions.

While the present invention has been described as in connection with a preferred embodiment thereof, it will be apparent to those skilled in the art that many changes and modifications can be made without departing from the spirit and scope of the invention. Accordingly, it is intended by the appended claims to cover all such changes and modifications encompassed by the spirit and scope of the appended claims.

What is claimed is:

1. A height and pivotal adjustable office chair arm assembly having an arm rest assembly thereon and comprising:

an arm support having one end for attaching the arm chair assembly to a chair and having an opposite end;

a gas cylinder associated with said arm support for movement in the vertical direction to raise and lower the arm rest assembly to any selected vertical position;

a shroud surrounding, and vertically removable in relation to, at least a portion of said arm support and having an upper end;

said shroud being connected to said gas cylinder for vertical movement by said cylinder;

an arm rest pivot support attached only to said shroud for receiving said arm rest assembly and enabling said arm rest assembly to pivot in the horizontal plane, thereby allowing said arm rest assembly to assume any selected rotational position;

a hollow tube for slidably receiving said arm support; and a cross-sectional shape that conforms to the cross-sectional shape of the arm support and being such that the shroud can move vertically with respect to the arm support but is non-rotatable with respect to the arm support.

2. The assembly of claim 1 wherein said shroud and arm support both have an ovate cross-sectional shape.

3. A height and pivotal adjustable office chair arm assembly having an arm rest assembly thereon and comprising:

an arm support having one end for attaching the arm chair assembly to a chair and having an opposite end;

a gas cylinder associated with said arm support for movement in the vertical direction to raise and lower the arm rest assembly to any selected vertical position;

a shroud surrounding, and vertically removable in relation to, at least a portion of said arm support and having an upper end;

said shroud being connected to said gas cylinder for vertical movement by said cylinder;

an arm rest pivot support attached only to said shroud for receiving said arm rest assembly and enabling said arm rest assembly to pivot in the horizontal plane, thereby allowing said arm rest assembly to assume any selected rotational position;

an upper arm pad assembly for receiving the arm of the user; and a lower arm pad assembly having a first end attached to the upper arm pad assembly and having a second end for mating with the arm rest support and shroud.

4. The assembly of claim 3 further comprising:

a detent means carried by the upper end of said shroud to assist in holding the arm rest in a given horizontal rotational position; and said lower arm pad assembly having at least one bearing and spring assembly for matingly engaging the detent means on the shroud such that the bearing may rotatably move from one detent to another as said arm rest pivot support is rotated about a substantially-vertical axis to establish a given rotational position of said arm rest assembly.

5. The assembly of claim 4 further comprising:

a plurality of vertically-oriented detents in said shroud; and at least one bearing and spring assembly on said lower arm pad assembly such that each of said bearings radially engages a different one of said detents for releasably holding said arm rest assembly in said given rotational position.

6. The assembly of claim 5 wherein said bearings are elongated roller bearings biased radially against elongated vertically-positioned detents by said springs.

7. The assembly of claim 5 wherein said bearings are ball bearings biased radially against said detents by said springs.

8. The assembly of claim 5 further comprising:

at least two sets of three detents, each of said sets disposing on diametrically-opposed sides of said shroud; and said at least one bearing radially and releasably engaging a corresponding set of detents.

9. The assembly of claim 5 further comprising:

a circular detent means having an outer periphery for carrying said vertically-oriented detents; and said bearing and spring assemblies being spaced from each other with each of said bearings releasably and radially engaging corresponding detents and enabling said arm rest assembly to assume any selected horizontal position represented by said detents.

10. The assembly of claim 9 wherein said detents allow 40° rotation of said arm rest assembly.

11. A height and pivotal adjustable office chair arm assembly having an arm rest assembly thereon and comprising:

an arm support having one end for attaching the arm chair assembly to a chair and having an opposite end;

a gas cylinder associated with said arm support for movement in the vertical direction to raise and lower the arm rest assembly to any selected vertical position;

a shroud surrounding, and vertically removable in relation to, at least a portion of said arm support and having an upper end;

said shroud being connected to said gas cylinder for vertical movement by said cylinder;

an arm rest pivot support attached only to said shroud for receiving said arm rest assembly and enabling said arm rest assembly to pivot in the horizontal plane, thereby allowing said arm rest assembly to assume any selected rotational position;

a substantially V-shaped arm pad assembly having first and second legs joined at one end;

said first leg forming a substantially horizontal upper rest for the user's arm; and said second leg being a lower rest for attachment to said shroud upper end; and said first leg being longer than said second leg.

12. The assembly of claim 11 wherein:

said second leg is at least partially hollow;

a lever actuator extending from the hollow portion of said second leg; and a lever extending through said partially hollow second leg between said lever actuator and said gas cylinder such that said lever actuator can be used to move said lever to actuate said gas cylinder and enable raising and lowering of said arm rest assembly.

13. The assembly as in claim 12 wherein both a hollow main arm support and the shroud have corresponding cross-sectional shapes that prevent rotation of said shroud with respect to said main arm support that allows relative vertical movement of said shroud with respect to said main arm support.

14. The assembly of claim 13 wherein said bearings are roller bearings in a bearing cage with a long bearing axis in the vertical plane for radially engaging said detents to releasably hold said arm rest assembly in a given located position.

15. The assembly of claim 13 wherein said bearings are ball bearings in a bearing cage for radially engaging said detents to releasably hold said arm rest assembly in a given rotated position.

16. An adjustable office chair arm assembly comprising:

an arm support having one end for attaching to a chair and a generally upstanding opposite end with a central opening and an outer surface;

structural elements located within said central opening for adjusting the vertical height of an attached armrest to one of a plurality of vertical positions;

a shroud surrounding at least a portion of said outer surface of said arm support, said shroud vertically movable relative to said arm support, said shroud being connected to said structural elements for being moved vertically, and said shroud having a flange, said flange having a plurality of detents; and an armrest pivot support attached only to said shroud and pivotable independently of the vertical height of said shroud, said armrest pivot support having movable structural elements to engage said detents thereby allowing said armrest assembly to assume one of a plurality of rotational positions; and wherein said flange is cylindrical in form and said detents are vertically positioned; and said structural elements of said armrest pivot support are horizontally movable, spring biased balls.

* * * * *